US005487532A

United States Patent [19]

Lonardi et al.

[11] Patent Number: 5,487,532

[45] Date of Patent: Jan. 30, 1996

[54] DEVICE FOR INSERTING A LANCE INTO A PRESSURIZED CONTAINER, IN PARTICULAR A BLAST FURNACE

[75] Inventors: Emile Lonardi, Bascharage; Radomir Andonov, Mamer; Giovanni Cimenti, Fentange, all of Luxembourg

[73] Assignee: Paul Wurth S.A., Luxembourg

[21] Appl. No.: 250,754

[22] Filed: May 26, 1994

[30] Foreign Application Priority Data

May 27, 1993 [LU] Luxembourg ..... 88 280

[51] Int. Cl.[6] ..... C21C 5/48

[52] U.S. Cl. ..... 266/271; 266/225; 266/47

[58] Field of Search ..... 266/271, 47, 225

[56] References Cited

U.S. PATENT DOCUMENTS 3,643,508 2/1972 Schneider .

4,471,664 9/1984 Mailliet et al. .

4,997,475 3/1991 Feuillerat et al. ..... 266/271

*Primary Examiner*—Melvyn Andrews

*Attorney, Agent, or Firm*—Fishman, Dionne & Cantor

[57] ABSTRACT

A device is presented which equips an opening made in a pressurized container, in particular a blast furnace, for the axial insertion of a lance. This device comprises an axial sealing member, a casing, a first fixed seat, a second axially movable seat and a closure element. The closure element is fitted with a separation spring which produces an axial clearance with respect to the first seat. Closure springs apply the second seat onto the closure element and the closure element onto the first seat. Active opening members, for examples jacks, act against the closure springs. In a preferred embodiment, the device further comprises a spacer element which is identical to the closure element except that it is provided with a through opening for the lance.

20 Claims, 5 Drawing Sheets

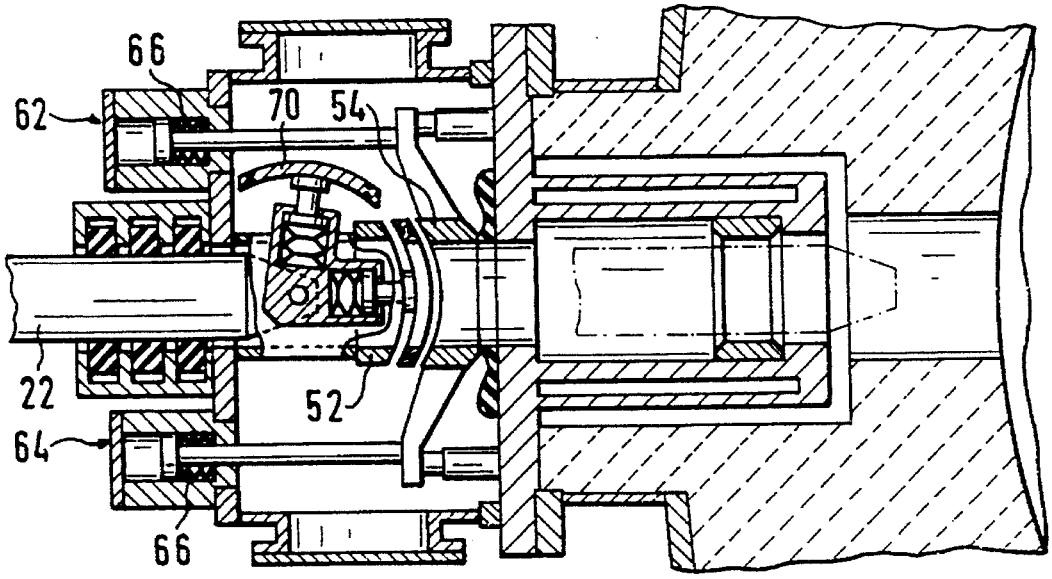
Fig. 5
Fig. 6
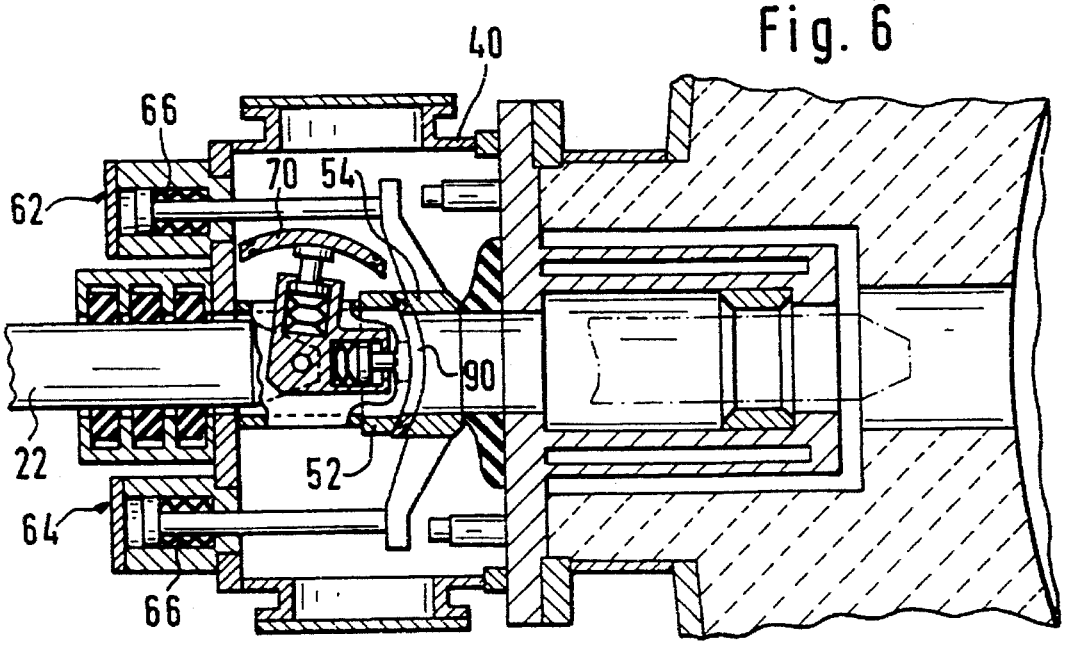

DEVICE FOR INSERTING A LANCE INTO A PRESSURIZED CONTAINER, IN PARTICULAR A BLAST FURNACE

BACKGROUND OF THE INVENTION

This invention relates generally to devices for inserting a lance into a pressurized container, in particular a blast furnace. More particularly, this invention relates to a device for equipping an opening for the axial insertion of a lance into a pressurized container such as a blast furnace without loss of leak tightness, either during insertion of the lance or total closure of the opening when the lance is entirely withdrawn.

A device of this kind for inserting a measuring probe into a blast furnace is known from U.S. Pat. No. 3,643,508. This device comprises a closure member which is fixed with one end on a pipe of a blast furnace and which supports an axial sealing member at its free end. The closure member comprises a double disc fitted, on one side, with a solid disc and, on the other side, with a disc pierced with a through opening for the lance. This double disc is pivotable about a pivot axis parallel to the central axis of the device and is provided with a slight axial clearance along this pivot axis. In order to close the pipe of the blast furnace, the solid disc is pivoted into an axial position between a first flange, fixed onto the pipe of the blast furnace, and a second flange, supporting the sealing member. The two flanges are then axially clamped by screws and nuts in order to guarantee leaktightness around the solid disc. In order to pass the lance through the pipe, the two flanges are unclamped and the disc provided with the through opening for the lance is pivoted into the axial position between the two flanges, before reclamping the flanges axially. The axial sealing member of this device is fitted with a simple packing box. In order to compensate for a slight axial misalignment of the lance, the axial sealing member is fixed onto the second flange so as to be movable perpendicularly to the central axis of the device. For various reasons such as productivity and other reasons it is self-evident that a device of this type has not been and is not currently satisfactory. In fact, during the exchange of the solid disc and the pierced disc, the device provided is even incapable of avoiding leaks from the pressurized container.

An improved embodiment of this device is known from German Patent Application DE 15 33 829. The closure member also comprises a double disc with a through opening for the lance. This double disc is, however, surrounded by a leaktight casing, in which it is pivotable about a pivot axis parallel to the central axis of the device and has a slight axial clearance on this pivot axis. In order to improve the leaktightness around the solid disc, and the pierced disc respectively, the device is fitted with an annular hydraulic piston which is equipped with sealing gaskets. When this annular hydraulic piston is actuated, these sealing gaskets are applied onto the respective disc which is in front of them. This disc in turn bears on sealing gaskets integrated in an axially opposite surface. A disadvantage of this solution is that, during the pivoting of the double disc, the sealing gaskets bearing on the double disc are highly stressed. In order to increase the life of the sealing gaskets the aforementioned patent application provided these sealing gaskets with a special lubricating system. It will also be noted that, in the event of sealing problems with the annular hydraulic piston, the leaktightness of the device provided in this German Patent can no longer be reestablished.

It will be appreciated that there is a need to provide a device equipping an opening made in a pressurized container, in particular a blast furnace, for the axial insertion of a lance therein, which ensures more reliable leaktightness than the devices of the prior art.

SUMMARY OF THE INVENTION

The above-discussed and other problems and deficiencies of the prior art are overcome or alleviated by the device for inserting a lance into a pressurized container, in particular a blast furnace of the present invention. In accordance with the present invention, a device for equipping an opening for the axial insertion of a lance into a pressurized container such as a blast furnaces comprises:

(1) a sealing member designed to ensure axial leaktightness around the lance when the lance is inserted therein, (2) a leaktight casing situated between the pressurized container and the aforementioned sealing member and provided with first and second through openings for the lance, these through openings being axially spaced, (3) a first seat situated inside the leaktight casing and connected in a leaktight manner to the first through opening for the lance, (4) a second seat situated inside the leaktight casing and connected in a leaktight manner to the second through opening for the lance, the second seat being arranged axially opposite the first seat and being axially movable with respect to the first seat, (5) a closure element mounted in the leaktight casing so as to be movable, by a first movement, between an axial position in which it is axially aligned between the first and the second seat and a lateral position in which it is situated outside of the axial alignment of the two seats and, by a second movement, axially between the first and the second seat, (6) at least one separation spring which is connected to the closure element so as to produce an axial clearance between the first seat and the closure element when the closure element is in its axial position, (7) at least one closure spring which is connected to the second seat so as to move it towards the first seat and which is dimensioned so that the second seat can push the closure element, against the action of the separation spring or springs, against the first seat when this closure element is in its axial position, and (8) at least one active opening control member which is connected to the second seat and which is dimensioned so as to be able to move the second seat, against the action of the closure spring or springs, in the direction opposite the first seat into a retracted position in which the second seat defines an axial clearance with respect to the closure element when the closure element is in its axial position.

An important advantage of the device in accordance with the present invention is that it is a "fail safe" device. In fact, the force which applies the second seat onto the closure element and the closure element onto the first seat, thus ensuring leaktightness, is produced by the closure spring, that is to say a passive element, which requires no additional energy. The active opening control member, for example a linear or a rotary motor, which requires an additional (hydraulic or electrical) energy supply, is only involved in the case of intentional elimination of leaktightness of the container with respect to the leaktight casing; that is to say during the axial separation of the second seat with respect to the first seat.

A further advantage of the device provided in accordance with the present invention is that the first seat defines a first axial clearance with respect to the closure element, and the second seat defines a second axial clearance with respect to the closure element, before movement of the closure element from its axial position into its lateral position and vice versa. It will be appreciated that this first clearance and this second clearance ensure that during the movement of the closure element, that the contact surfaces are not stressed. A lubrication system for sealing elements or surfaces is therefore superfluous. Both clearances are established automatically, by simple recoil of the second seat into its retracted position.

To insert the lance into the pressurized container, after having inserted the lance with its front end into the sealing member and after having moved the second seat into its retracted position, the closure element is moved into its lateral position, which frees the axial passage for the lance through the device. Now, in this position, the leaktight casing is exposed to the pressure and the atmosphere of the pressurized container. If it is desired to reestablish the leaktightness of the leaktight casing with respect to the pressurized container, it is now possible to deactivate the opening control member, which will cause the second seat to be applied axially onto the first seat, under the action of the closure spring or springs. In order to guarantee the leaktightness between the two seats, it is sufficient, for example, to provide an elastic sealing element on at least one of the two seats. With the aim of simplifying the seats, and above all with the aim of reducing the axial travel of the second seat, it is preferable to fit the device with a spacer element which is identical to the closure element except the fact that this closure element is provided with a through opening for the lance. This spacer element is mounted in the leaktight casing in the same manner as the aforementioned closure element. In other words, it is movable, by a first movement, between a lateral position in which it is situated outside of the axial alignment of the two seats (when the closure element is in its axial position), and an axial position in which it is axially aligned between the first and the second seat (when the closure element is in its lateral position), and, by a second movement, axially between the first and the second seat. At least one separation spring is preferably connected to the spacer element so as to produce an axial clearance between the first seat and the spacer element, when the spacer element is in its axial position.

The closure element and the spacer element are advantageously fitted with sealing gaskets which are mounted so as to be opposite corresponding sealing surfaces of the first and second seats, when the closure element and the spacer element respectively are situated in their axial position. In order to fully understand the advantage of not having sealing gaskets on the seats, but of having them on the closure and spacer elements, it is important to note that the closure element and the spacer element are replaceable, in their lateral position, without breaking the leaktightness with respect to the pressurized container. In order to have access to the sealing surfaces of the first and second seats, it is, however, necessary to break the leaktightness with respect to the pressurized container.

In a preferred embodiment, the closure element and, optionally, the spacer element are pivotable about a pivot axis which cuts the axis along which the lance is inserted. These elements are then plates axially bounded by surfaces of revolution, the axis of revolution of which corresponds to the aforementioned pivot axis. These surfaces of revolution face complementary sealing surfaces of the first seat and of the second seat when the respective plate is in its axial position between the two seats. This is an embodiment which makes it possible to have a leaktight casing with a smaller size than a device of the type provided in DE 15 33 829, which is fitted with a double disc that can be pivoted above an axis parallel to the axis along which the lance is inserted.

In another preferred embodiment, for a lance having a cross-section which is higher than it is wide, the pivot axis is parallel to the height of the aforementioned cross-section, and the surfaces of revolution are cylindrical surfaces. This is a solution which makes it possible to have minimal size of the leaktight casing.

In all the embodiments of the device in accordance with the present invention, there is most often the advantage of choosing an active opening control member which comprises one or more hydraulic jacks in which the closure springs are integrated. This results in a relatively compact and simple device.

If the hydraulic jacks are then mounted outside the leaktight casing and connected to the second seat by control rods which penetrate into the leaktight casing, neither the jacks nor the springs will be exposed to the atmosphere prevailing in the leaktight casing.

It is possible to provide mechanical means (for example a screw, a hook, etc.) for temporarily blocking the second seat in a sealing position. In this position the second seat sealably bears either on the closure element which then itself bears sealably on the first seat or on the said spacer element which then itself bears sealably on the first seat. In this way, it is possible to interchange the closure spring or springs without breaking the leaktightness with respect to the pressurized container.

In a preferred embodiment, the device comprises at least one axial stop, for the second seat. This axial stop is preferably adjustable in order to axially block the second seat both in its retracted position and in its sealing position.

Preferably, the device in accordance with the present invention comprises an axial compensator which is connected between the second seat and the second axial through opening for the lance. This approach eliminates the need to use sealing gaskets of the "O-ring" type or packing boxes, which might possibly constitute unnecessary weak points.

One simple way of supporting the closure element and/or the spacer element is to provide telescopic support arms. The spacer springs are then advantageously integrated in these telescopic arms.

In a preferred embodiment, the device in accordance with the present invention comprises the following elements:

(1) the first seat is supported inside the leaktight casing by a passage sleeve for the lance, (2) each of the two telescopic arms of the closure element is fitted with a pivot pin, and (3) housings for the pivot pins are provided between the leaktight casing and the sleeve, so as to define a pivot axis for the closure element and/or spacer element, which cuts the central axis of the device provided.

It will be appreciated that a preferred embodiment of the sealing member is also provided. This sealing member comprises:

(1) a casing subdivided into chambers separated axially by ribs, and (2) rings provided with a passage cross-section which matches the cross-section of the lance, each of the rings being mounted in one of the chambers of the casing so as to be able to slide in the casing perpendicularly with respect to the central axis of the sealing member.

This preferred embodiment not only allows axial misalignment of the lance, but also improves the leaktightness when the lance is inserted obliquely through the device of the present invention. Furthermore, the sealing elements do not undergo exaggerated local compressive forces during oblique insertion of the lance into the sealing member.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES:

FIGS. 3 to 6 represent identical views to that in FIG. 1 and show the device in various operating positions.

DESCRIPTION OF THE PREFERRED EMBODIMENT

Figure 1:
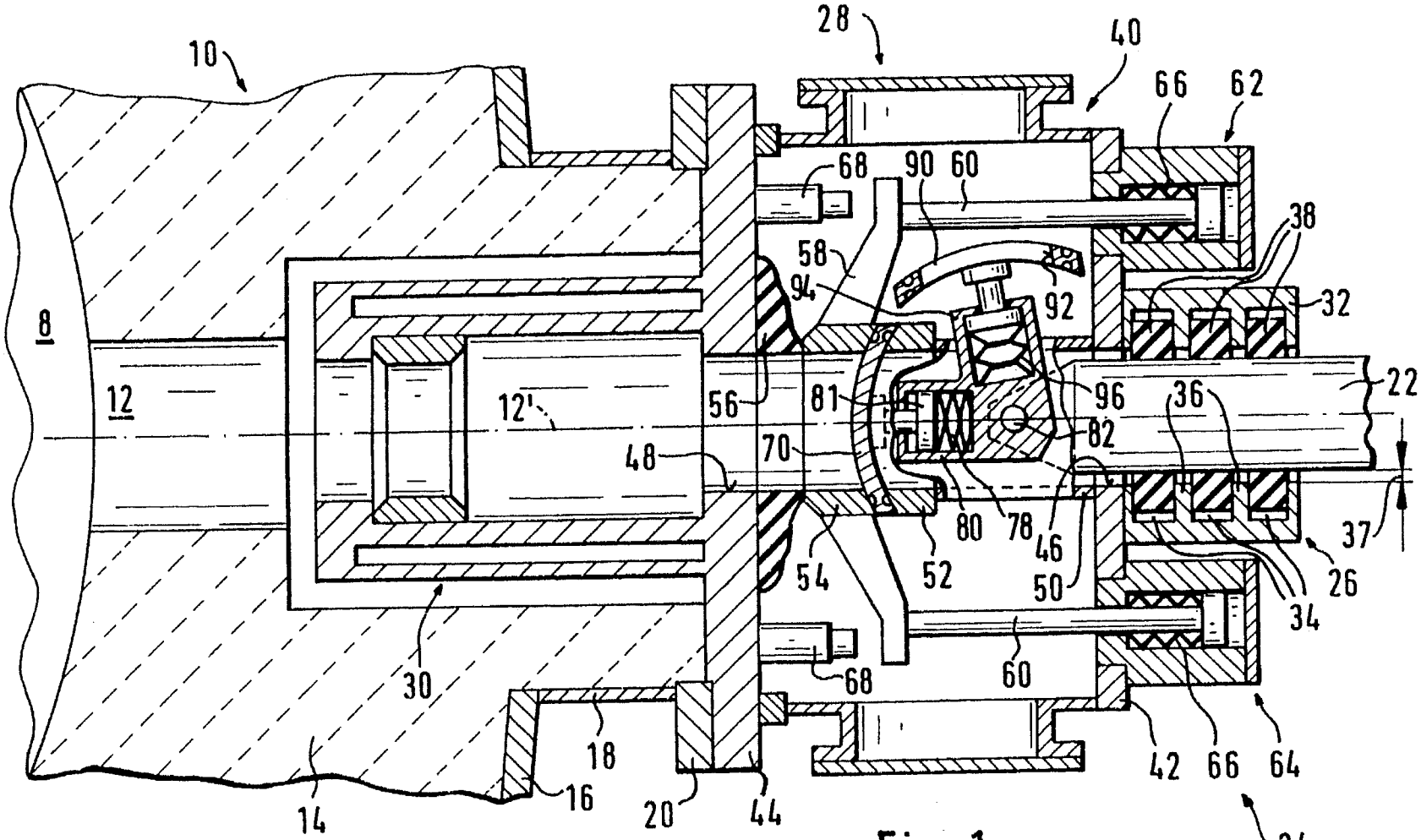
FIG. 1 represents a section through the central axis of a device in accordance with the present invention.

Referring first to FIG. 1, the device for inserting a lance into a pressurized container, in particular a blast furnace, of the present invention is shown in section through the central axis by the entire FIG. 1.

Figure 2:
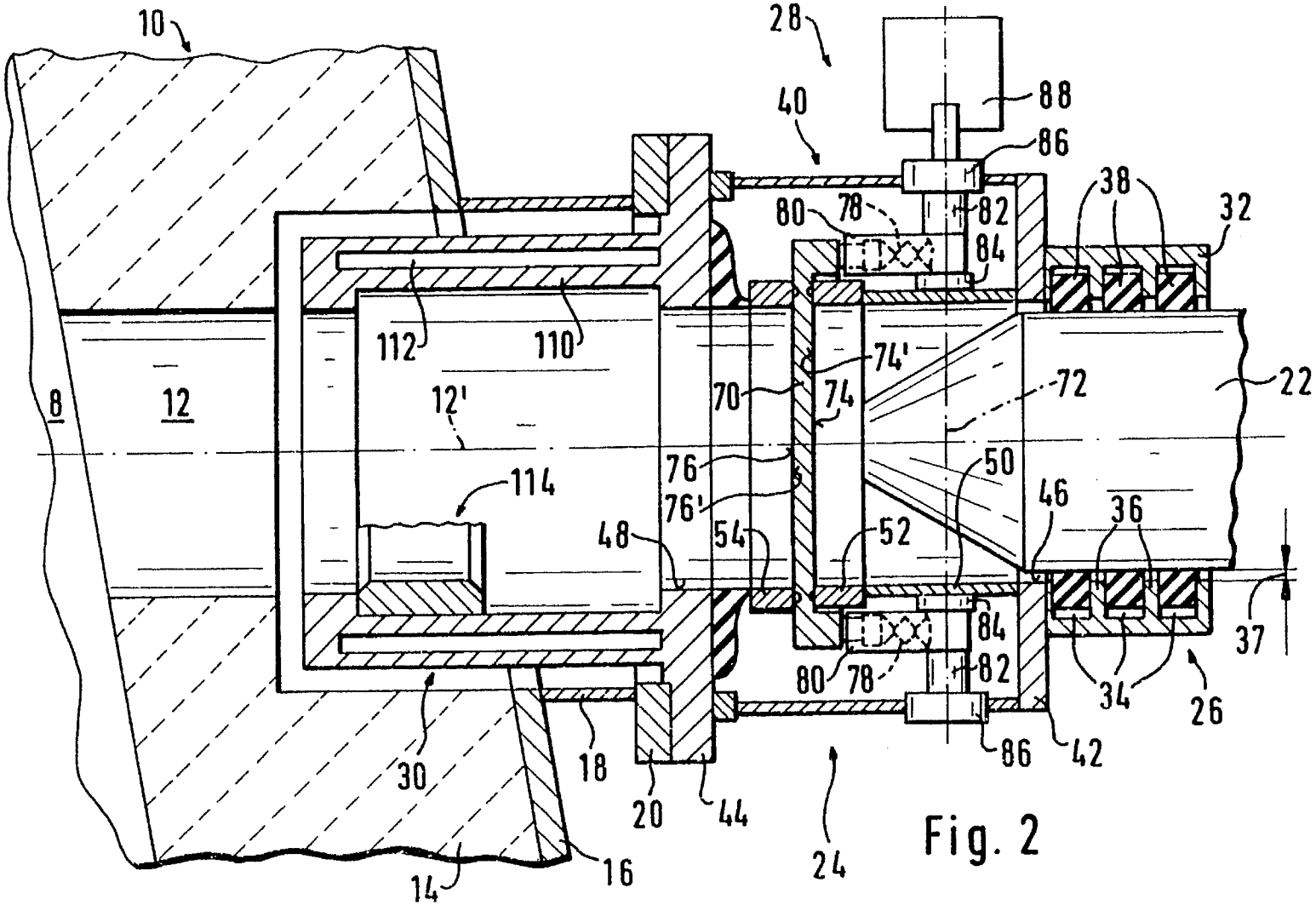
FIG. 2 represents a section through the device of FIG. 1 at an angle of 90° with the section plane of FIG. 1.

FIG. 1 shows a section through a wall 10 of a pressurized container 8, for example a blast furnace, at the level of an opening 12 which passes through this wall 10. FIG. 2 shows a similar section, making an angle of 90° with the section plane of FIG. 1. The wall 10, represented by way of illustration, comprises an inner refractory lining 14 and an outer shielding 16. At the level of the opening 12, the shielding 16 forms a sleeve 18 which is fitted with a flange 20. The central axis of this flange 20 defines the central axis 12' of the opening 12 in the wall 10.

The reference 22 identifies a lance which is to be inserted along the axis 12' through the opening 12 in the container 8. It will be assumed that this is, for example, a probe for making temperature measurements and/or for taking samples of gas from the charge of a blast furnace. Such a probe, which is inserted almost horizontally into the charge, may have a length of 8 meters or more. In order to improve its strength, it is generally of oval cross-section, that is to say that its height is larger than its width, as can be seen by comparing FIG. 1, which represents a section through a horizontal plane, with FIG. 2, which represents a section through a vertical plane.

The reference 24 refers overall to a device which equips the opening 12 and which allows insertion of the lance or probe 22 through this opening 12 into the container or blast furnace 8. The device 24 which is represented in the FIGURES comprises, for this purpose, from the outside inwards: a sealing member 26, a closure member 28 and a support member 30. Before describing these three members in detail, their function will be described in brief. The sealing member ensures the axial leaktightness around the lance 22. It will be noted that, as long as the lance 22 is engaged in the sealing member 26, it provides leaktight closure of the opening 12. The closure member 28 makes it possible to close the opening 12 in a leaktight manner when the lance 22 is to be entirely withdrawn from the sealing member 26. The support member 30 constitutes a front support for the lance 22. This support has the purpose of reducing the overhanging length of the lance 22 inside the container 8.

The sealing member 26 comprises a casing 32 which is subdivided into several chambers 34. These chambers 34 are separated axially by ribs 36 which define, with respect to the cross-section of the lance 22, a large clearance referred to, for example, by the reference 37. The reference 38 labels rings whose free cross-section matches the cross-section of the lance 22. Each of these rings 38 is mounted in one of the chambers 34 so as to be movable perpendicularly to the central axis 12' of the sealing member 26. This possibility of movement of the rings 38 in their respective chamber 34 of the casing 32 allows the rings 38 to adapt to an oblique position of the lance 22 in the sealing member 26. In other words, the rings 38 can be freely centered on the lance 22 when it is inserted obliquely through the sealing member 26.

It will be noted that the rings 38 constitute either themselves sealing members, or supports for packings or sealing gaskets which bear on the lance 22. It will also be noted that at least one of the rings 38 advantageously constitutes a support for a sealing gasket which can be inflated by a liquid or a gas. This inflatable gasket then makes it possible to make a larger and variable clearance between the lance and the respective ring leaktight.

Figure 2A:
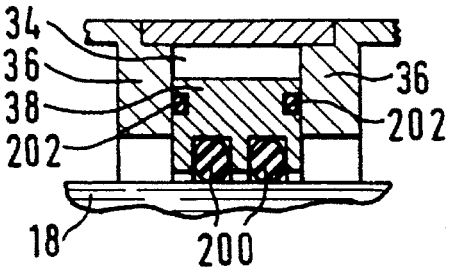
FIGS. 2A and 2B show details of a sealing member equipping the device of FIGS. 1 and 2.

FIG. 2A represents a detail of a first embodiment of a ring 38 in its chamber 34. It is seen that it is fitted with two sealing gaskets 200 with which it bears on the lance 22. Lateral sealing gaskets 202 provide, if necessary, leaktightness between the ring 38 and the radial ribs 36 defining the chamber 34.

Figure 2B:
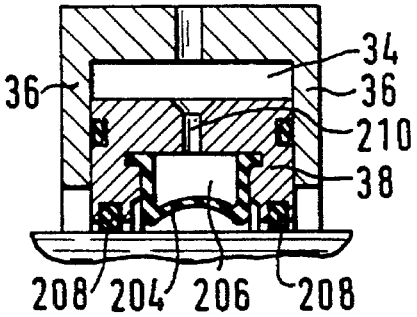

FIG. 2B represents an alternative embodiment of the ring 38 in its chamber 34. It comprises an inflatable seal 204 installed in a cavity 206 of the ring 38. In the deflated position, this inflatable seal 204 is set back in its cavity 206, which makes it possible to move the lance 22 without damaging or wearing the inflatable seal 204. In the inflated position, the inflatable seal 204 of FIG. 2B is capable of compensating for much larger radial clearances than the two sealing gaskets 200 in FIG. 2A. As in FIG. 2A, the ring 38 advantageously bears with two sealing gaskets 208, which flank the cavity 206, on the lance 22. The inflatable seal 204 is advantageously pressurized by pressurizing the chamber 34. Openings 210 in the ring 38 connect the chamber 34 with the cavity 206. It should be noted that the inflatable seal 204 may be inflated by a liquid or a gas under pressure.

The closure member 28 comprises a leaktight casing 40 which is fitted with a first end plate 42 and with a second end plate 44 which are axially separated from each other. On the end plate 44 side, the leaktight casing 40 is fixed in a leaktight manner onto the flange 20 of the container 8. On the end plate 42 side, it supports the sealing member 26 in a leaktight manner.

The plates 42 and 44 comprise through openings 46 and 48, coaxial with the central axis 12' for passage of the lance 22. The opening 46 in the plate 42 is fitted with a sleeve 50, for the passage of the lance 22, which extends axially towards the opening 48 in the plate 44. At a certain distance from the plate 44, the sleeve 50 ends in a first seat 52 which surrounds the mouth of the sleeve 50 in the leaktight casing 40. A second seat 54 axially faces the first seat 52. This second seat 54 is connected in a leaktight manner to the first plate 44. In addition, it is axially movable in the casing 40.

In the device shown in the attached FIGURES, the connection of the second seat 54 to the plate 44 is accomplished by using an axial compensator 56. The second seat 54 might, however, also be engaged on or in a guide sleeve supported by the plate 44, on condition that suitable sealing elements are provided between the second seat 54 and this guide sleeve, which sealing elements tolerate an axial movement between the second seat 54 and the guide sleeve without being worn too quickly.

The second seat 54 is preferably fitted with a kind of stirrup piece 58 to which control rods 60 are connected which extend, parallel to the axis 12', through the plate 42 outside the leaktight casing 40. These control rods 60 are used for moving the second seat 54 axially.

The references 62 and 64 label means for driving the rods 60, for example jacks fitted with closure springs 66. It is important to note that the spring elements 66, which are preferably integrated in the jacks 62 and 64, are designed to exert on the second seat 54 a force in the direction of the first seat 52. Pressurizing the jacks 62, 64 moves the second seat 54 axially away from the first seat 52, against the action of the springs 66. Axial stops 68 limit the axial movement of the second seat 54 in the direction of the plate 44, and define a limit retracted position of the plate 44. These axial stops 68 might however also be replaced by stops which are integrated in the jacks 62 and 64.

The reference 70 labels the closure element proper of the closure member 28. It is, for example, a cylindrical plate which can be pivoted about an axis 72 which intersects the axis 12'. In FIG. 2, this axis cuts the axis 12', for example at a right angle. In order to decrease the axial size of the closure member 28, the pivotable closure plate 70 is advantageously axially defined by a first surface 74 and a second surface 76 which are surfaces of revolution having the pivot axis 72 for the plate 70 as the axis of revolution. In particular, these surfaces 74 and 76 may be cylindrical surfaces coaxial with the axis 72, as represented in the FIGURES. They may, however, also consist of spherical or conical surfaces, or even be surfaces of revolution generated by the rotation of any generatrix curve around the axis 72. What is important is that the seats 52 and 54 are axially defined by sealing surfaces complementary to the first surface 74 and the second surface 76 of the closure element 70 respectively. In the device represented in the FIGURES, the seats 52 and 54 are then axially defined by cylindrical surfaces 74' and 76' which are complementary to the cylindrical surfaces 74 and 76 of the cylindrical plate 70.

It will be noted that the suspension of the cylindrical plate 70 in the leaktight casing 40 has to be designed so that it can be moved by the second seat 54 in the direction of the first seat 52 against the action of an elastic force, when it is located axially between the first seat 52 and the second seat 54. In the device represented in the FIGURES, the suspension of the cylindrical plate 70 in the leaktight casing 40 is, for this purpose, produced using two telescopic arms 80 which are situated on either side of the sleeve 50. Springs 78 are integrated in the telescopic arms 80 so as to move the closure element 70 away from the fixed seat 52. A stop 81, integrated in the telescopic arm 80, defines the maximal extension of these telescopic arms 80, that is to say the travel of the closure element 70 under the effect of the spacer springs 78.

The arms 80 are each fitted with a pivot pin 82, which is, for example, housed with one end in a first bearing 84 which is supported by the sleeve 50, and with a second end in a second bearing 86 which is supported by the casing 40. One of the two pivot pins 82 is then connected to a drive member 88 which is diagrammatically represented in FIG. 2. It will be noted that this drive member 88 is designed to be able to pivot the closure element 70 through an angle of approximately 90° about the axis 72.

The pivot pins 82 support not only the closure element 70 but also a spacer element 90 which is itself also pivotable about the axis 72. This spacer element 90 is exactly identical to the closure element 70 apart from the fact that its cylindrical plate is provided with a through opening 92 for the lance 22. It is mounted on the pivot pins 82 so as to be directly next to the closure element 70. Like the closure element 70, the spacer element 90 is itself also fitted with telescopic arms 94 which are equipped with springs 96, so as to move it axially away from the seat 52. Instead of providing telescopic arms 80 and 94 with springs 78, 96 for the closure element 70 and the spacer element 90, it might also be possible to provide support arms of fixed length and to give the pivot pins 82 a possibility of axial movement against a spring.

From the point of view of leaktightness, it will be noted that the closure element 70, as well as the spacer element 90, are fitted on both sides with sealing gaskets. These sealing gaskets are mounted on the closure element 70 and the spacer element 90 so as to be situated facing the sealing surface 74' of the first seat 52 and the sealing surface 76' of the second seat 54 respectively, when these elements 70 and 90 are situated in axial alignment between the two seats 52 and 54.

The support member 30 is described with the aid of FIGS. 1 and 2. It comprises a sleeve 110, which extends overhanging towards the inside of the container 8. The sleeve 110, which is preferably integral with the plate 44, is advantageously provided with a cooling circuit 112 if the conditions inside the pressurized container 8 so require, as is, for example, the case on a shaft furnace or a blast furnace. With its free end, the sleeve 110 supports an internal support 114 for the lance 22. This is a bearing on which the lance 22 can bear with its lower periphery when it is inserted through a side opening of the wall 10. Its purpose is then to decrease the overhanging length of the lance 22 inside the container 8. If the lance 22 is, on the other hand, inserted vertically into the container 8, or, if it only has a small overhanging length inside the container 8, it is naturally possible to do without this support member 30. It will then be noted that the presence of the support member 30 is justified only in particular applications, which involve reducing the maximum bending moment and shearing force to which the lance 22 is subjected when it is overhanging in the container 8. Such is, for example, the case for the temperature and gas-sampling probes for blast furnaces.

Figure 3:
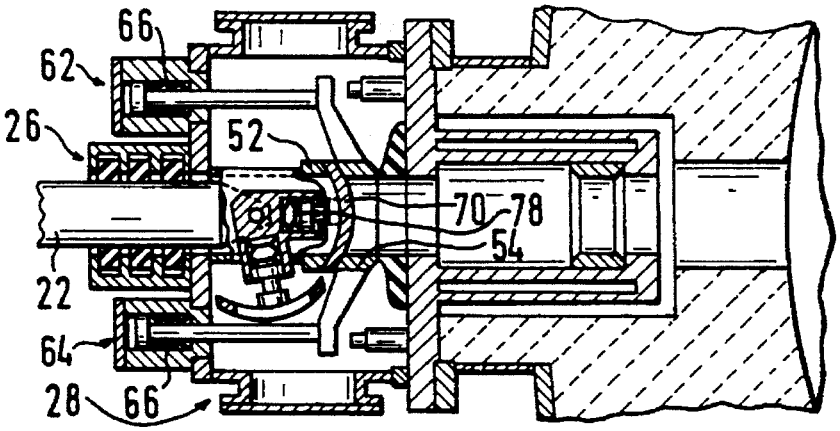

The operation of the device provided by the present invention will be described with the aid of FIGS. 3 to 6. In FIG. 3, the lance 22 is inserted with its front end into the sealing member 26. The closure member is in the closed position, that is to say the jacks 62 and 64 are not pressurized, and the springs 66 exert a force on the second seat 54 in the direction of the first seat 52. The second seat 54 bears, by virtue of the action of the springs 66, with its sealing surface on the closure element 70 which is arranged axially between the first and the second seat 52 and 54 and applies the closure element 70, against the action of the spacer spring 78, on the sealing surface of the first seat 52. In other words, the closure member 28 is held closed by the action of the closure springs 66 which hold the second seat 54, the closure element 70 and the first seat 52 axially in leaktight bearing on one another.

In order to allow insertion of the lance 22 into the container 8, the jacks 62 and 64 are first of all pressurized. These jacks 62 and 64 then exert a pressure on the second seat 54 which opposes the action of the spring 66 and moves the seat axially away from the first seat 52. By virtue of the spacer spring 78, the closure element 70 follows the recoil movement of the second seat 54, until it is stopped by the stop 81. At this moment there is a first axial clearance between the sealing surface of the first seat 52 and the sealing gaskets incorporated in the first surface 74 of the closure element 70. The second seat 54 continues its recoil movement in the direction of the second end plate 44, until it bears, for example via the stirrup piece 58, on the axial stops 68. In this retracted position, there is a second axial clearance between the sealing gaskets incorporated in the second surface 76 of the closure element 70 and the sealing surface of the second seat 54. By virtue of this first and this second axial clearance, the closure element 70 can be pivoted about the axis 72 by the drive member 88 (cf FIG. 2) into a lateral position with respect to the two seats 52 and 54 without risking damage to the sealing gaskets.

Figure 4:
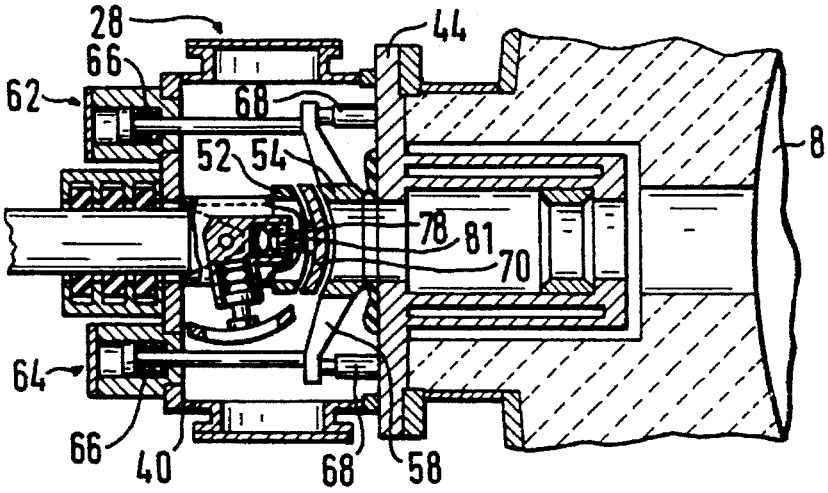

It will be noted that, in FIGS. 4 and 5, the leaktight casing 40 is in direct communication with the container 8. The leaktightness of the leaktight casing 40 with respect to the surroundings is guaranteed by the end of the lance 22 which is engaged in the sealing member 26. In order to limit the exposure of the casing 40 to the atmosphere prevailing in the container 8, and in order to limit, for example in the case of a blast furnace, the penetration of dust into the casing 40, it is most often advantageous to isolate the leaktight casing 40 with respect to the container 8 when the closure element 70 is in the lateral position with respect to the two seats 52 and 54. For this purpose, it would be possible simply to cut the supply pressure of the jacks 62 and 64, in order to apply the seat 54 directly against the seat 52 by means of the closure springs 66. This approach would, however, make it necessary to design the sealing surface 74' of the first seat 52 and 76' of the second seat 54, respectively, so as to ensure not only leaktightness when they are applied against the surfaces 76 and 74 of the closure element 70, but also when they are applied on one another. In order to avoid this problem, and in order at the same time to limit an excessively large axial movement of the second seat 54, the spacer element 90 has been provided. This spacer element 90 is automatically axially positioned, after pivoting of the closure element 70 into its lateral position, between the first seat 52 and the second seat 54 (cf. FIG. 5).

After cutting the supply of the jacks 62 and 64, the closure springs 66 hold the second seat 54, the spacer element 90 and the first seat 52 axially bearing in a leaktight manner on one another. It will be noted that, in this situation which is represented in FIG. 6, the sealing gaskets of the spacer element 90 are applied exactly in the same manner on the sealing surfaces 74' and 76' of the first and second seats 52 and 54 respectively, as the sealing gaskets of the closure element 70 are in the situation represented in FIG. 3. In addition, the second seat 54 occupies exactly the same position in FIG. 6 as in FIG. 3. In the situation represented in FIG. 6, the leaktight casing 40 is now passed through by a leaktight channel for the lance which is formed, in the direction of insertion of the lance, by the sleeve 50, the first seat 52, the spacer element 90, the second seat 54 and the axial compensator 56.

Other advantages and features of the closure member in FIGS. 1 to 6 will be described with the aid of FIG. 7. In this FIGURE, the closure member 28 is in the same position as that represented in FIG. 6. It will be noted that the leaktight casing 40 is provided with two juxtaposed access openings 100 and 102 which give access to the inside of the leaktight casing 40, or more precisely to the two lateral positions, in which the closure element 70 and the spacer element 90 are respectively situated when they are pivoted out of axial alignment with the two seats 52 and 54.

Figure 7:
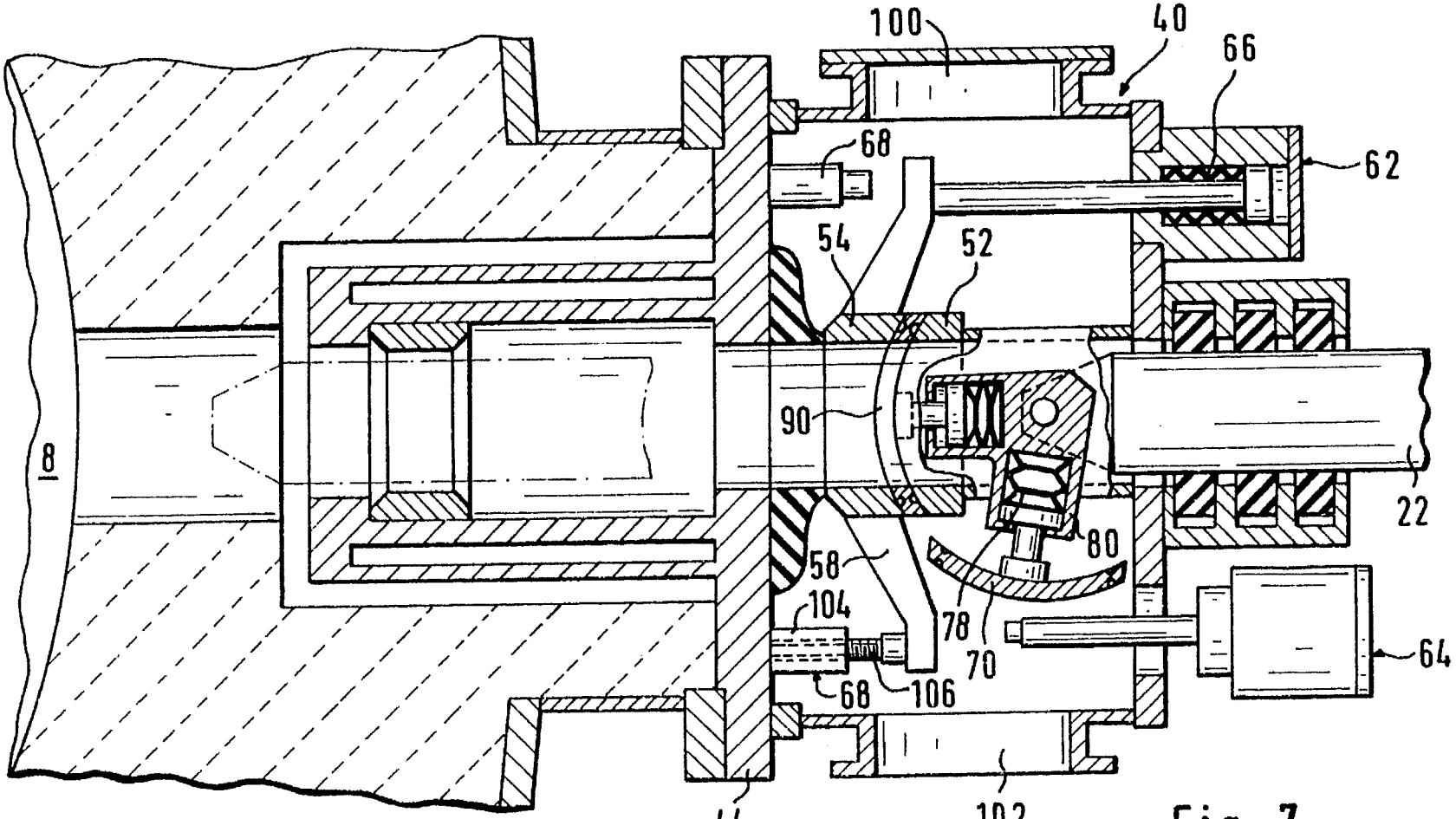
FIG. 7 is an identical view to FIG. 1, in which additional advantages of the device have been illustrated.

In FIG. 7, the access opening 102, which gives access to the closure element 70, is open, while the access opening 100 is closed. It will be noted that it is thus easily possible to remove the closure element 70, which is, for example, fixed by screws onto the arm 80, while at the same time retaining leaktightness with respect to the container 8. In this position, it is also possible to replace the separation springs 78 in the telescopic arms 80. If it is desired to remove the spacer element 90, the closure member 28 is placed in the position represented in FIG. 3 and the access opening 100 is open. It will be appreciated that all the sealing gaskets are supported either by the closure element 70 or by the spacer element 90, which are both easily removable. In order to be able to replace these sealing gaskets, it is then sufficient to remove these two elements 70 and 90 in succession and to carry out the replacement of the sealing gaskets in the workshop. The advantage is that this replacement of the seals can be carried out when the container 8 is under pressure. The replacement of the seals of the closure element 70 can even be carried out without the need to withdraw the lance 22 from the container 8.

Another feature of the device represented in the FIGURES is that it is possible to remove the jacks 62 and 64 containing the closure springs 66, without thereby losing leaktightness with respect to the container 8. For this purpose, the stops 68 are axially adjustable so as to make it possible to block the second seat 54 and the spacer element 90, and the closure element 70 respectively, axially against the first seat 52. In FIG. 7, the stops 68 comprise, for example, a sleeve 104 with an internal screw thread fixed onto the plate 44, into which a threaded rod 106 is screwed. The latter is designed so as to be able to bear on the stirrup piece 58 when the second support 54 presses the spacer element 90 and the closure element 70 respectively onto the first seat 52. In this position, the stops 68 replace the closure springs 66 and it is possible to remove the jacks 62 and/or 64 containing the closure springs 66 without any problems. After remounting the jacks 62 and/or 64, the threaded rod 106 is driven into the sleeve 104 in order to define the maximum travel of the second seat 54 in the direction of the second plate 44. It will also be appreciated that, in the device represented in the FIGURES, the jacks 62 and 64 and the closure springs 66 are arranged outside the leaktight casing 40. In this way, these essential elements are never exposed to the atmosphere prevailing in the container 8.

While preferred embodiments have been shown and described, various modifications and substitutions may be made thereto, without departing from the spirit and scope of the invention. Accordingly, it is to be understood that the present invention has been described by way of illustrations and not limitations.

What is claimed is:

1. A device for equipping an opening in a pressurized container for the axial insertion of a lance, the device comprising:

a leaktight casing including:

a first plate intended to be connected to a pressurized container and a second plate spaced from said first plate;

a first through opening in said first plate and a second through opening in said second plate, each of said openings intended for passing therethrough a lance;

sealing means attached to said second plate for establishing axial leaktightness around a lance when a lance is inserted therein;

passage means in said leaktight casing between said first and second through openings for establishing a passage for a lance between said first and second through openings, said passage means having an axis and including;

a first seat connected in a leaktight manner to said second through opening;

a second seat being connected in a leaktight manner to said first through opening, said second seat being arranged opposite said first seat along said axis and being movable along said axis with respect to said first seat;

closure means mounted in the leaktight casing for opening and closing said passage means between said first and second seats, said closure means being movable between a first position in which said closure means is aligned between said first seat and said second seat and a second position in which said closure means is outside of said first and second seats;

means for moving said closure means between said first and second positions;

first spring means for urging said closure means toward said second seat when said closure element is in its first position;

second spring means connected to said second seat to move said second seat towards said first seat whereby said second seat can urge said closure element, against the action of said first spring means, toward said first seat when said closure means is in its first position; and actuator means connected to said second seat to move said second seat, against the action of said second spring means, away from said first seat into a retracted position in which said second seat is axially spaced from said closure element.

2. The device of claim 1, wherein said closure means is pivotable about a pivot axis which intersects the axis of said passage said closure means is axially bounded by two surfaces of revolution, the axis of revolution each of which correspond to said pivot axis; and said surfaces of revolution face complementary sealing surfaces of said first seat and of said second seat when said closure element is in its axial position.

3. The device of claim 2, wherein:

said first and second seats each have a free cross section with a height larger than the width whereby they can accommodate passage of a lance which has a cross-section which is higher than wide, and wherein said pivot axis is parallel to the height of said cross-sections and said surfaces of revolution of said closure element are cylindrical surfaces.

4. The device of claim 1, comprising:

a spacer element having a through opening for a lance.

5. The device of claim 4, wherein:

said spacer element is mounted in the leaktight casing so as to be movable between a first position in which said spacer element is outside of said first and second seats when said closure means is in its first position a second position in which said spacer element is aligned between said first and second seats when said closure means is in its second position; and at least one spring means connected to said spacer element so as to produce an axial clearance between said first seat and said spacer element when said spacer element is in its second position.

6. The device of claim 5, wherein said closure means and spacer elements are fitted with sealing gaskets which are mounted so as to be situated facing complementary sealing surfaces of said first and second seat, when said closure and spacer elements respectively are situated in said axial position.

7. The device according of claim 1, wherein said actuator means comprises at least one hydraulic jack.

8. The device of claim 7, wherein said at least one hydraulic jack is mounted outside said leaktight casing and is connected to said second seat by a control rod which penetrates into said leaktight casing.

9. The device according of claim 6, wherein said actuator means member comprises at least one hydraulic jack.

10. The device of claim 9, wherein said at least one hydraulic jack is mounted outside said leaktight casing and is connected to said second seat by a control rod which penetrates into said leaktight casing.

11. The device of claim 10, including:

means for blocking said second seat in a sealing position in which, when said closure element is in the first position thereof, said second seat sealably bears on said closure element which, in turn, bears sealably on said first seat, and when said spacer element is in the second position thereof, said second seat sealably bears on said spacer element which, in turn, bears sealably on said first seat.

12. The device of claim 11 including:

at least one axial stop limiting the axial recoil of said second seat, said axial stop being adjustable in order to define a retracted position of said second seat and to axially block said second seat in said sealing position.

13. The device of claim 1 including:

an axial compensator which is connected between said second seat and said first through opening in said first plate.

14. The device of claim 1, wherein said closure means is supported by two telescopic arms.

15. The device of claim 14, wherein said first spring means is between said telescopic arms.

16. The device of claim 14, wherein:

said first seat is supported by said passage means inside said leaktight casing;

each of said two telescopic arms of said closure means is fitted with a pivot pin; and housings for said pivot pins are provided between said leaktight casing and said passage means, so as to define said pivot axis.

17. The device of claim 1, including:

access openings which are arranged laterally in said leaktight casing.

18. The device of claim 1, wherein said sealing means comprises:

a casing subdivided into chambers separated axially by ribs, and rings provided with a passage cross-section which matches the cross-section of a lance to be inserted, each of said rings being mounted in one of said chambers so as to be able to slide in the respective chamber perpendicularly with respect to the central axis of the sealing member.

19. The device of claim 16, wherein at least one of said rings supports at least one sealing member to bear on a lance.

20. The device of claim 16, wherein at least one of said rings supports an inflatable seal.

* * * * *